US005357168A

United States Patent [19]

See

[11] Patent Number: 5,357,168

[45] Date of Patent: Oct. 18, 1994

[54] MAGNETRON HAVING A CATHODE WITH TAPERED END SHIELDS

[75] Inventor: Seok K. See, Seoul, Rep. of Korea

[73] Assignee: Goldstar Co., Ltd., Seoul, Rep. of Korea

[21] Appl. No.: 945,794

[22] Filed: Sep. 16, 1992

[30] Foreign Application Priority Data

Sep. 17, 1991 [KR] Rep. of Korea ..... 1991-15211

[51] Int. Cl.[5] ..... H01J 23/05; H01J 25/50

[52] U.S. Cl. ..... 315/39.51; 315/39.71; 315/39.63; 315/39.67

[58] Field of Search ..... 315/39.51, 39.63, 39.67, 315/39.71

[56] References Cited

U.S. PATENT DOCUMENTS

| | | | |
|---|---|---|---|
| 3,046,444 | 7/1962 | Downing et al. | 315/39.51 |
| 4,187,444 | 2/1980 | Gerard | 315/39.71 |
| 4,194,142 | 3/1980 | Gerard | 315/39.51 X |
| 4,280,078 | 7/1981 | Tsutsui et al. | 315/39.75 X |

FOREIGN PATENT DOCUMENTS 62-113336 5/1987 Japan .

*Primary Examiner*—Benny T. Lee

*Attorney, Agent, or Firm*—Morgan & Finnegan

[57] ABSTRACT

This invention relates to a magnetron which is adapted to increase electrostatic capacitance between holes of magnetic pole pieces and end shields to improve oscillation efficiency. The magnetron comprises an anode cylinder, anode vanes attached to inner surface of the anode cylinder which defines a space upper and lower magnetic pole pieces mounted on the both ends of the anode cylinder each of which has hole, and a center bar disposed in the space which has upper and lower end shields at the both ends thereof and a coil filament thereon, wherein said holes of the magnetic pole pieces have outward tapered inner circumferential surfaces and said end shields have outward tapered outer circumferential surfaces corresponding to the tapered inner circumferential surfaces of the holes. It is possible to prevent the insulation located between the magnetic pole pieces and the end shields from being broken without reducing the spacings between the holes and the end shields. Without reducing the spacings, the inner circumferential surfaces of the holes and the outer circumferential surfaces of the end shields are broadened, thereby increasing Q value of resonator and oscillation efficiency.

2 Claims, 2 Drawing Sheets

MAGNETRON HAVING A CATHODE WITH TAPERED END SHIELDS

BACKGROUND OF THE INVENTION

1. Field of the Invention

The present invention relates to a magnetron, and more particularly to a magnetron which is adapted to operate under large electrical energy, for example, electrostatic capacitance between inner circumferential surfaces of holes formed at magnetic pole pieces and outer circumferential surfaces of upper and lower end shields so as to improve oscillation efficiency.

2. Description of the Prior Art

Referring to FIG. 1, there is shown a conventional magnetron. The magnetron comprises an anode cylinder 1, an upper magnetic pole piece 2 positioned above the anode cylinder 1 which has an upper hole 2' and a lower magnetic pole piece 3 positioned under the anode cylinder 1 which has a lower hole 3'. Anode vanes 4 are radially arranged and attached to the inner circumferential surface of the anode cylinder 1. The anode vanes 4 define at inner ends thereof a central space having diameter equal to that of holes 2' and 3' of the magnetic pole pieces 2 and 3. A center bar 8 having upper and lower end shields 6 and 7 is positioned in the hole of the vanes 4. A coil filament 5 is inserted on the center bar 8 between the end shields 6 and 7.

The magnetic pole pieces 2 and 3 is made of ferromagnetic material so as to focus or direct the magnetic flux in a space between the anode vanes 4 and the coil filament 5. End spaces 10 and 11 are provided between the upper and lower magnetic pole pieces 2 and 3 and the anode vanes 4, respectively.

Upon supplying the magnetron with electric power in order to generate an electromagnetic wave, high voltage of 4 KV is applied between the coil filament 5 of the center bar 8 and the anode vanes 4 and thermions (thermal electrons) having magnetic flux density of 1750 gauss are emitted from the coil filament 5. The emitted thermions are in a cycloidal orbit in the space 9 between the filament 5 and the anode vanes 4 by electric field and magnetic field and thus generate microwave energy. The microwave energy is directed to a waveguide (not shown) through an output antenna (not shown).

Oscillation efficiency of the magnetron is generally increased in proportion to increase of energy Q value (Q factor) of the resonator. The oscillation efficiency is affected by various factors such as magnetic flux distribution in the space 9, ratio of radius of hole of the anode vanes to radius of the coil filament, and the size and shape of the holes of the magnetic pole pieces.

Also, the Q value of the magnetron is increased in proportion to increase of electrical property or energy, for example, electrostatic capacitance between outer circumferential surfaces of end shields and inner circumferential surface of magnetic pole pieces and thus oscillation efficiency is also improved in proportion to the increase of electrostatic capacitance.

Referring to FIG. 2, there is shown an enlarged fragmentary section of the magnetic pole pieces and the end shield shown in FIG. 1. In the drawing, if it is assumed that an imaginary reference plane is z, a distance between the imaginary reference plane and an imaginary center plane of outer portion of the end shield 6 is x, and a distance between the imaginary reference plane and an imaginary center plane of the hole 2' of the magnetic pole pieces 2 is y, the distance x does not coincide with the distance y. Therefore, the electrical property or energy between the outer circumferential surfaces of the end shields and the inner circumferential surface of the magnetic pole pieces can not be large.

Accordingly, if the imaginary center plane of the holes 2' and 3' of the magnetic pole pieces 2 and 3 comes close to the imaginary central plane of the outer portion of the end shields 6 and 7 which are disposed on opposite ends of center bar 8, that is, the distance y is shortened to equal the distance x in order to increase electrostatic capacitance between the end shields 6 and 7 and the magnetic pole pieces 2 and 3, since inner surfaces of the magnetic pole pieces 2 and 3 are in contact with or too close to the vanes 4, electric field which is to be directed to the vanes 4 from the coil filament 5 curves toward the magnetic pole pieces 2 and 3 at inner edge of the vane 4, thereby causing unsafe oscillation of the magnetron.

Contrary to the above-mentioned case, if the imaginary central plane of the outer portion of the end shields 6 and 7 comes close to the imaginary center plane of the holes 2' and 3' of the magnetic pole pieces 2 and 3, that is, the distance x is lengthened to equal the distance y, since the coil filament 5 is lengthened so that thermions emitted from both ends of the coil filament 5 are directed not toward vanes 4 but toward end spaces 10 and 11 defined between the vanes 4 and the magnetic pole pieces 2 and 3, the anode cylinder 1 is excessively heated.

In addition, although spacings between inner circumferential surfaces of the holes 2' and 3' of the magnetic pole pieces 2 and 3 and outer circumferential surfaces of the end shields 6 and 7 can be reduced in order to increase electrostatic capacitance, the reduction of spacings causes the insulation between the surfaces of the holes and surfaces of the end shields to be broken or damaged.

SUMMARY OF THE INVENTION

The present invention has been made in view of the above-described described problems occurring in the prior art magnetron and an object of the invention is to provide a magnetron which has outward tapered outer circumferential surfaces of end shields and outward tapered inner circumferential surfaces of holes of magnetic pole pieces corresponding to the tapered outer surfaces of the end shields so as to broaden the facing surfaces, thereby increasing electrostatic capacitance between the end shields and the magnetic pole pieces.

In accordance with the present invention, the object mentioned above can be accomplished by providing a magnetron comprising an anode cylinder, anode vanes attached to inner surface of the anode cylinder which defines a space between the anode vanes and the anode cylinder, upper and lower magnetic pole pieces mounted on the both ends of the anode cylinder each of which has hole, and a center bar disposed in the space which has upper and lower end shields at the both ends thereof and a coil filament thereon, characterized in that: said holes of the magnetic pole pieces have outward tapered inner circumferential surfaces, outer diameter of the holes being smaller than inner diameter of the holes, and said end shields have outward tapered outer circumferential surfaces corresponding to the tapered inner circumferential surfaces of the holes, outer diameter of the end shields being smaller than inner diameter of the end shields, thereby increasing electrostatic capacitance of the magnetron.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

A magnetron according to the present invention will now be described by referring to FIGS. 3 and 4 in the accompanying drawings.

Figure 1:
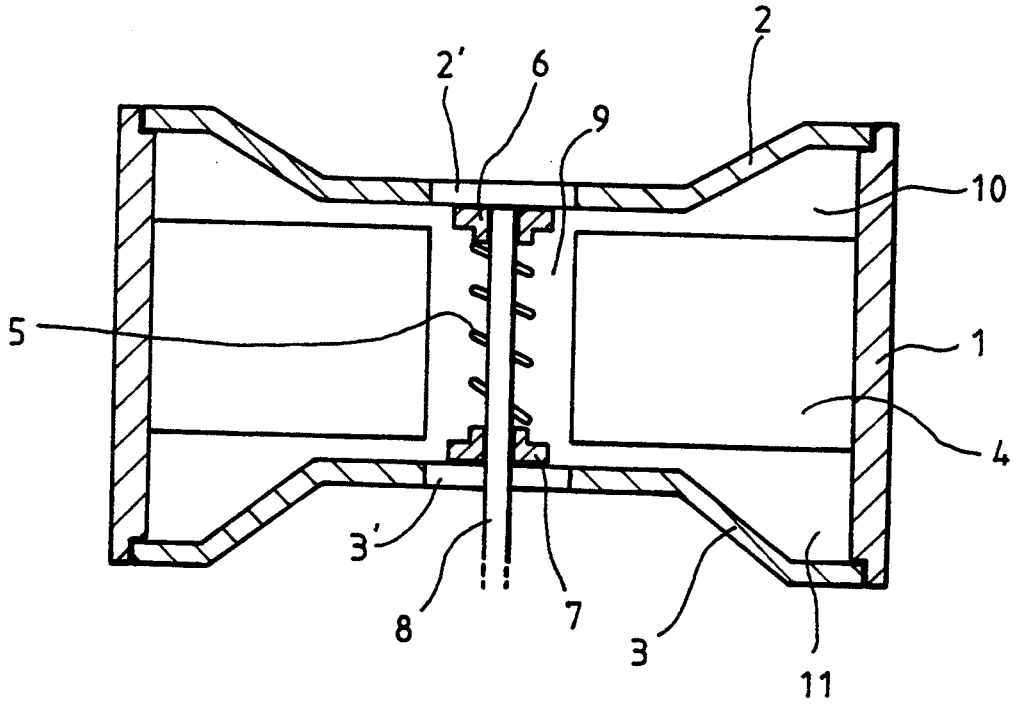
FIG. 1 Prior Art
FIG. 1 is a vertical sectional view of a known magnetron.
Figure 2:
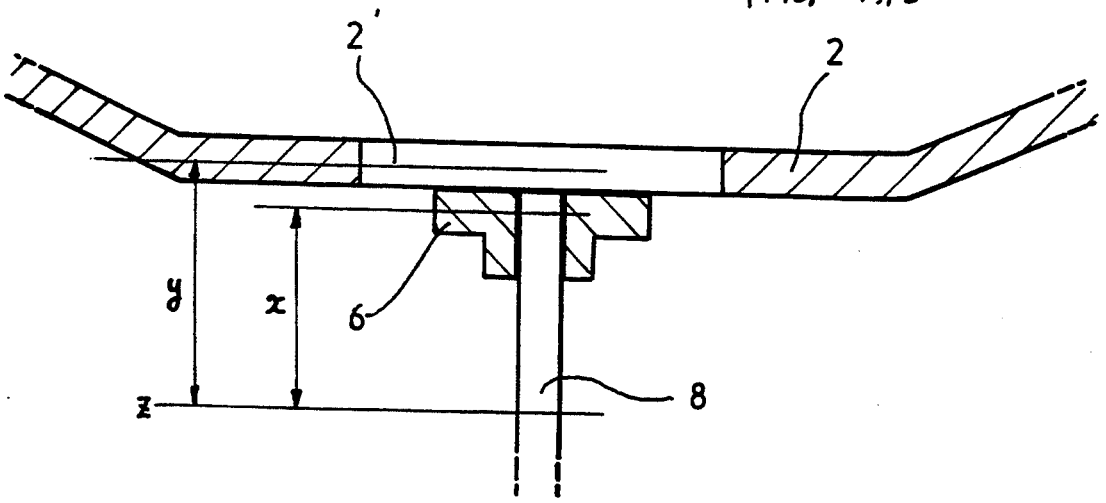
FIG. 2 Prior Art
FIG. 2 is an enlarged fragmentary sectional view of magnetic pole pieces and end shields shown in FIG. 1.
Figure 3:
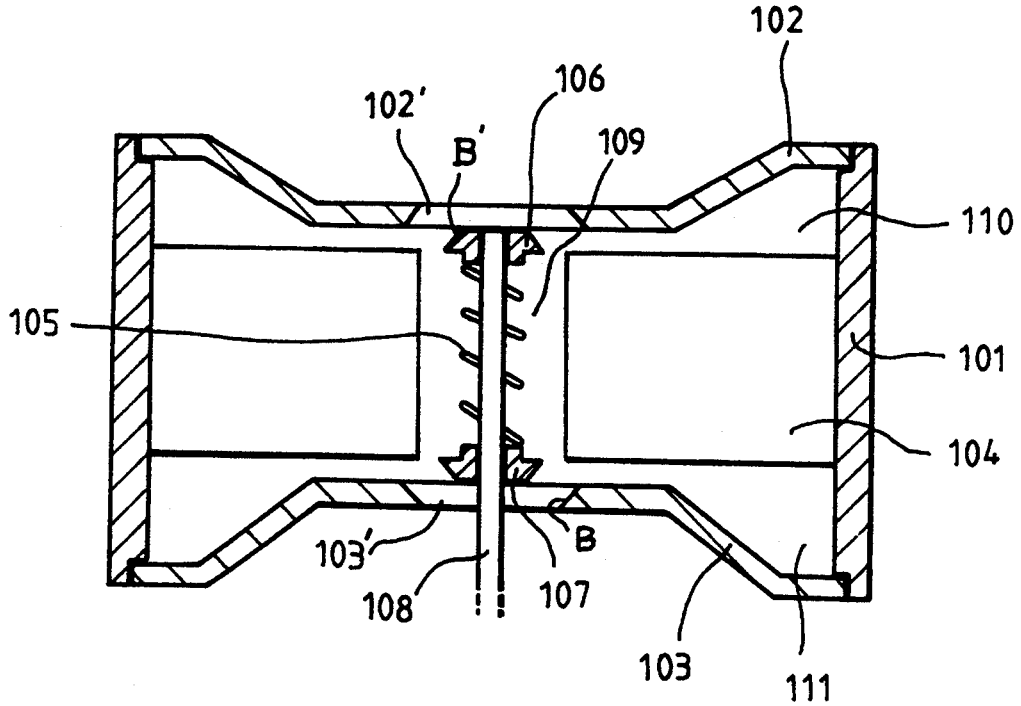
FIG. 3 is a vertical sectional view of a magnetron according to the invention.
Figure 4:
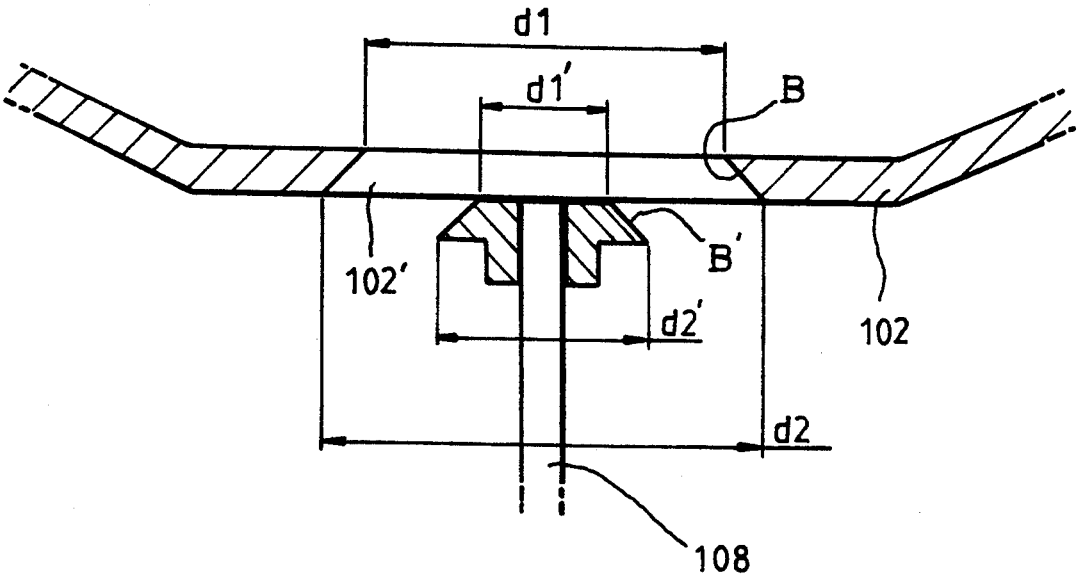
FIG. 4 is an enlarged fragmentary sectional view of magnetic pole pieces and end shields of the invention shown in FIG. 3.

As seen in FIG. 3, the magnetron according to the invention comprises an anode cylinder 101, anode vanes 104 which are radially arranged and attached to inner surface of the anode cylinder 101, and upper and lower magnetic pole pieces 102 and 103 which are positioned above and under the anode cylinder 101, respectively. Accordingly, between the magnetic pole pieces 102 and 103 and the anode vanes 104 are provided with end spaces 110 and 111. The magnetic pole pieces 102 and 103 have holes 102' and 103', respectively. The holes 102' and 103' have outward tapered inner circumferential surface "B" as shown in FIG. 4. That is, holes 102' and 103' are outwardly tapered toward the inside of the magnetron from the outside of the magnetron. Therefore, outer diameters "d1" of the holes 102' and 103' are smaller than inner diameters "d2' of the holes 102' and 103' as shown in FIG. 4.

A center bar 108 having upper and lower end shields 106 and 107 at both ends thereof is positioned in a hole defined by the inner ends of the anode vanes 104. A coil filament 105 is inserted on the center bar 108 and supported between the upper and lower end shields 106 and 107. Therefore, between the end shields 106 and 107, the magnetic pole pieces 102 and 103, and the vanes 104 is provided with a space 109 in which magnetic flux is focused or directed.

Each of the end shields 110 and 111 has an outward tapered outer circumferential surface "'" corresponding to the tapered inner circumferential surface "B" of the holes 102' and 103' formed at the magnetic pole pieces 102 and 103. Therefore, the outer diameters "d1" of the tapered end shields 106 and 107 are smaller than the inner diameters "d2" of the tapered shields 106 and 107.

Operation of the magnetron according to the present invention will be described as follows.

As the magnetron is supplied with electric power in order to generate, an electromagnetic wave, high voltage of 4 KV is applied between the filament 105 mounted on the center bar 108 and the anode vanes 104. At this time, since the magnetic pole pieces 102 and 103 mounted on upper and lower ends of the anode cylinder 101 are electrically connected to the anode vanes 104 and the upper and lower end shields 106 and 107 supporting the filament 105 are also electrically connected to the filament 105, thermions (thermal electrons) are emitted from the filament 105 by the voltage applied to the space 109 defined by the inner ends of the vanes 104. Therefore, as the emitted thermions evolve in the space 109, microwave energy is generated.

As mentioned above, since the inner circumferential surfaces "B" of the holes 102' and 103' formed at the magnetic pole pieces 102 and 103 are outward tapered in such a manner that the outer diameters "d1" of the holes 102' and 103' are smaller than the inner diameters "d2" of the holes 102' and 103', the inner surfaces "B" of the holes 102' and 103' are broadened. Also, since the outer circumferential surfaces "B'" of the end shields 106 and 107 are outward tapered in such a manner that the outer diameters "d1'" of the end shields 106 and 107 are smaller than the inner diameter "d2'" of the end shields 106 and 107, the outer surfaces "B'" of the end shields 106 and 107 are broadened.

Accordingly, the inner circumferential surfaces "B" of the holes 102' and 103' and the outer circumferential surfaces "B'" of the end shields 106 and 107, which face each other, are substantially broadened as compared with surfaces of a known magnetron, thereby causing electrostatic capacitance and thus Q value to be increased.

In addition, since the spacings between the inner circumferential surfaces "B" of the holes 102' and 103' formed at the magnetic pole pieces 102 and 103 and the outer circunferential surfaces "B'" of the end shields 106 and 107 will be maintained as similar to spacings of a known magnetron, it is possible to prevent the insulation between the magnetic pole pieces and the end shields from being broken or damaged. That is, without reducing the spacings, the inner circumferential surfaces "B" of the holes 102' and 103' and the outer circumferential surfaces "B'" of the end shields 106 and 107 are broadened. Therefore, it is possible to increase Q value of resonator and oscillation efficiency.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A cathode and anode assembly for a magnetron having an electrostatic capacitance associated therewith, comprising:

an anode cylinder having an inner surface and first and second ends, anode vanes attached to the inner surface of the anode cylinder which define a space at the first and second ends of said anode cylinder, upper and lower magnetic pole pieces mounted respectively on the first and second ends of the anode cylinder, said upper and lower magnetic pole pieces including upper and lower holes respectively, a center bar disposed in the space defined by said anode vanes, upper and lower end shields located respectively at the first and second ends of said anode cylinder, said upper end shield located directly below the upper hole of the upper magnetic pole piece and said lower end shield located directly above the lower hole of the lower magnetic pole piece, said upper and lower end shields having upper and lower shield holes which respectively receive said center bar, and a coil filament positioned on said center bar, wherein said upper and lower holes of the upper and lower magnetic pole pieces have respective outward tapered inner circumferential surfaces and said upper and lower end shields have respective outward tapered outer circumferential surfaces corresponding to the outward tapered inner circumferential surfaces of the upper and lower holes, resulting in an increase in the electrostatic capacitance of the magnetron.

2. A cathode and anode assembly for a magnetron according to claim 1, wherein the upper and lower holes each include upper and lower outer and inner diameters respectively, wherein the upper and lower end shields each include upper and lower shield outer and inner diameters respectively, and wherein the upper and lower outer diameters of the upper and lower holes are respectively smaller than the upper and lower inner diameters of the corresponding upper and lower holes, and upper and lower shield outer diameters of the upper and lower end shields are respectively smaller than upper and lower shield diameters of the corresponding upper and lower end shields.

* * * * *